US010818206B2

(12) United States Patent
Shibata et al.

(10) Patent No.: US 10,818,206 B2
(45) Date of Patent: Oct. 27, 2020

(54) DISPLAY APPARATUS AND CONSTRUCTION METHOD

(71) Applicant: SONY SEMICONDUCTOR SOLUTIONS CORPORATION, Kanagawa (JP)

(72) Inventors: Takahiro Shibata, Kanagawa (JP); Ichiro Mori, Kanagawa (JP)

(73) Assignee: SONY SEMICONDUCTOR SOLUTIONS CORPORATION, Kanagawa (JP)

( * ) Notice: Subject to any disclaimer, the term of this patent is extended or adjusted under 35 U.S.C. 154(b) by 0 days.

(21) Appl. No.: 15/572,389

(22) PCT Filed: Apr. 26, 2016

(86) PCT No.: PCT/JP2016/063028
§ 371 (c)(1),
(2) Date: Nov. 7, 2017

(87) PCT Pub. No.: WO2016/185882
PCT Pub. Date: Nov. 24, 2016

(65) Prior Publication Data

US 2018/0130389 A1 May 10, 2018

(30) Foreign Application Priority Data

May 19, 2015 (JP) ..... 2015-101645

(51) Int. Cl.
*G09F 7/18* (2006.01)
*G09F 19/22* (2006.01)
(Continued)

(52) U.S. Cl.
CPC ..... *G09F 19/226* (2013.01); *G09F 7/18* (2013.01); *G09F 7/20* (2013.01); *G09F 9/00* (2013.01);
(Continued)

(58) Field of Classification Search
CPC ..... G09F 19/226; G09F 9/3026; G09F 7/20; G09F 19/22; G09F 9/40; G09F 9/00; G09F 7/18; G09F 2007/186; G09F 2007/1834
See application file for complete search history.

(56) References Cited

U.S. PATENT DOCUMENTS 1,484,231 A * 2/1924 Pistocco ..... G09F 15/0025 40/617
3,484,070 A * 12/1969 Zukowska ..... A47F 5/08 24/298
(Continued)

FOREIGN PATENT DOCUMENTS

CN 101908308 A 12/2010
CN 102269317 A 12/2011
(Continued)

OTHER PUBLICATIONS

International Search Report and Written Opinion of PCT Application No. PCT/JP2016/063028, dated Jun. 28, 2016, 09 pages of ISRWO.

*Primary Examiner* — Cassandra Davis
(74) *Attorney, Agent, or Firm* — Chip Law Group

(57) ABSTRACT

A display apparatus includes: a plurality of display units that are two-dimensionally arranged; a supporting member that supports the plurality of display units; and an elastic member that partially couples the supporting member and each of some or all of the plurality of display units.

14 Claims, 12 Drawing Sheets

(51) Int. Cl.

| | |
|---|---|
| ***G09F 7/20*** | (2006.01) |
| ***G09F 9/40*** | (2006.01) |
| ***G09F 9/00*** | (2006.01) |
| ***G09F 9/302*** | (2006.01) |

(52) U.S. Cl.
CPC ..... *G09F 9/3026* (2013.01); *G09F 9/40* (2013.01); *G09F 19/22* (2013.01); *G09F 2007/186* (2013.01); *G09F 2007/1834* (2013.01)

(56) References Cited

U.S. PATENT DOCUMENTS

| | | | | | |
|---|---|---|---|---|---|
| 3,637,174 | A * | 1/1972 | Kuo | F16L 3/2053 | 248/542 |
| 3,853,226 | A * | 12/1974 | Hine | A47G 1/1606 | 211/104 |
| 4,025,011 | A * | 5/1977 | Rapps | F16L 3/2053 | 248/561 |
| 7,644,927 | B2 * | 1/2010 | Law | F41J 1/10 | 248/215 |
| 2005/0160648 | A1 * | 7/2005 | Voluckas | G09F 7/20 | 40/617 |
| 2006/0065806 | A1 * | 3/2006 | Shin | F16M 13/02 | 248/325 |
| 2010/0302284 | A1 | 12/2010 | Karaki | | |
| 2011/0297810 | A1 | 12/2011 | Tachibana | | |

FOREIGN PATENT DOCUMENTS

| | | | |
|---|---|---|---|
| JP | 2000-112376 | A | 4/2000 |
| JP | 2001-083891 | A | 3/2001 |
| JP | 2003-150083 | A | 5/2003 |
| JP | 2004-191401 | A | 7/2004 |
| JP | 2004-341468 | A | 12/2004 |
| JP | 2006-308949 | A | 11/2006 |
| JP | 2010-281911 | A | 12/2010 |
| JP | 2011-253080 | A | 12/2011 |
| JP | 2004-341468 | A | 12/2014 |

* cited by examiner

[ FIG. 1 ]
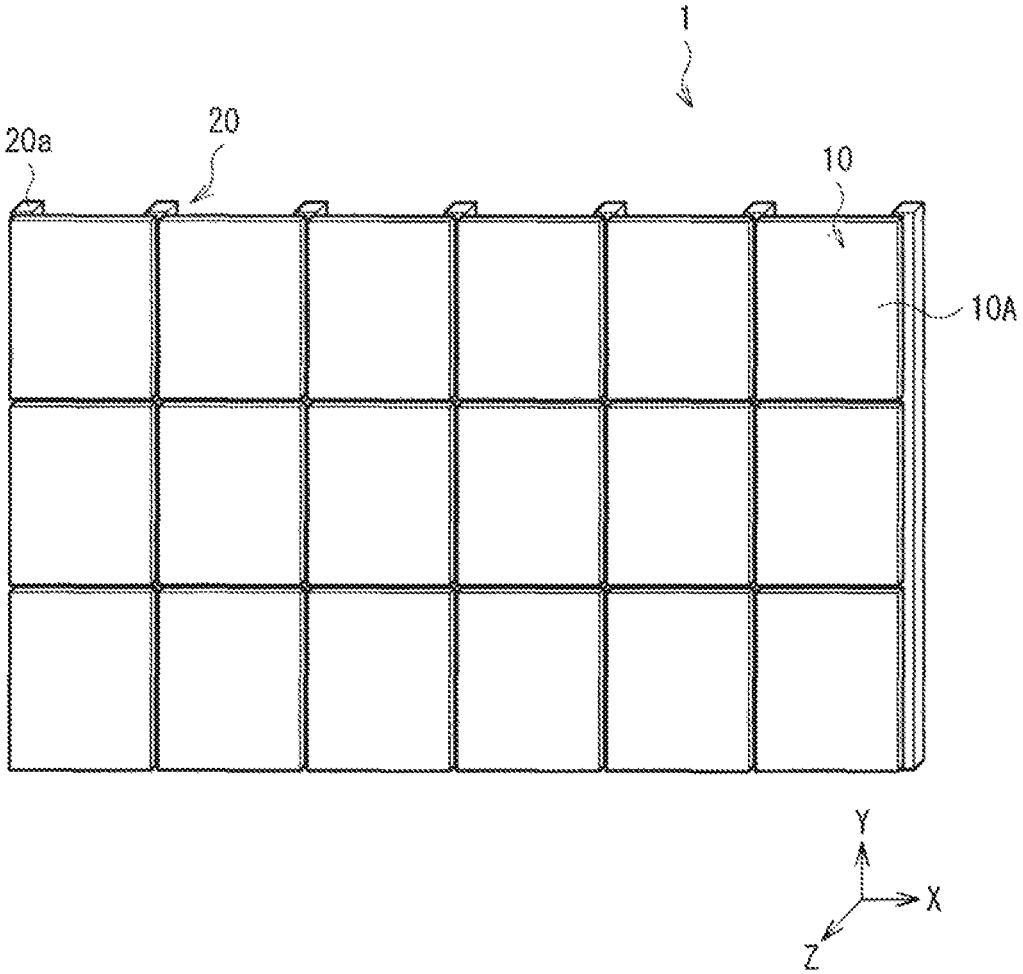

[ FIG. 2 ]
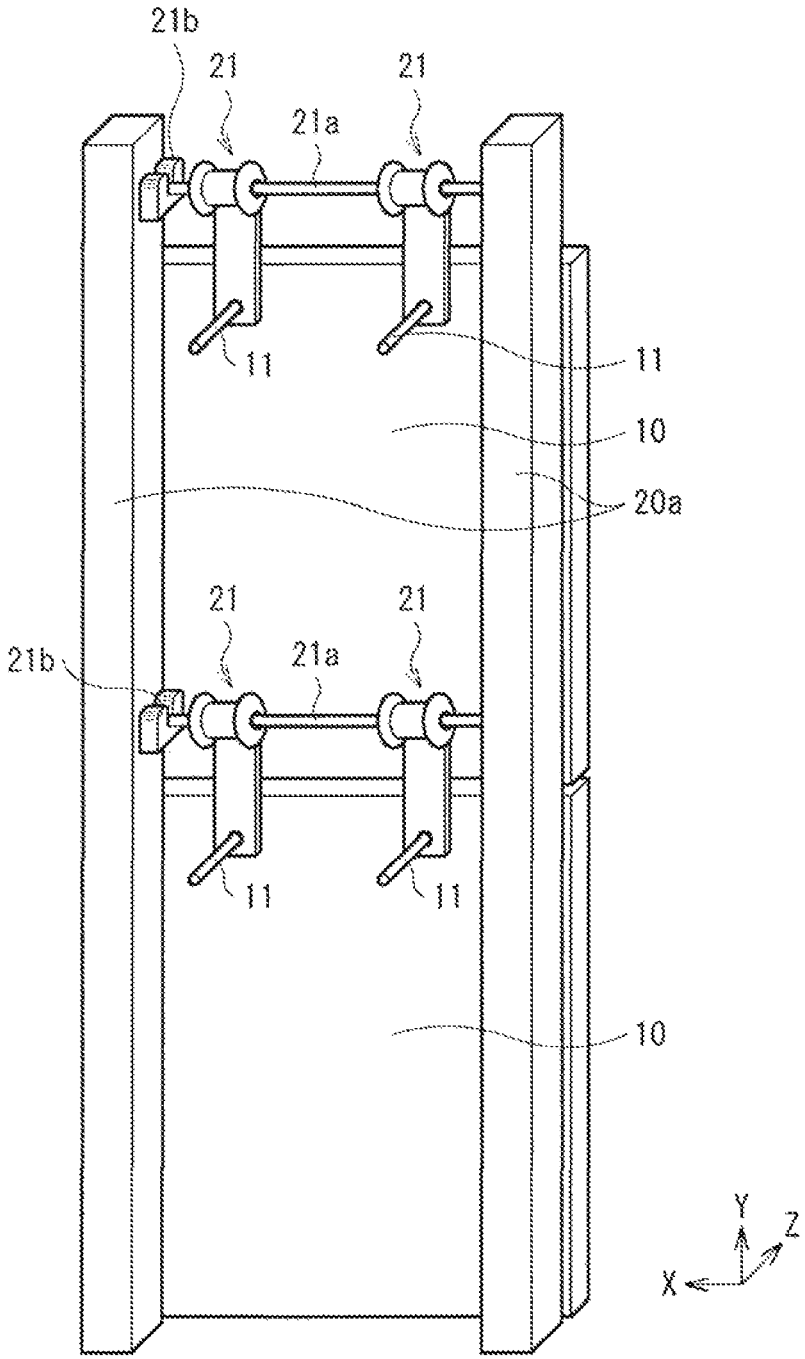

[ FIG. 3A ]
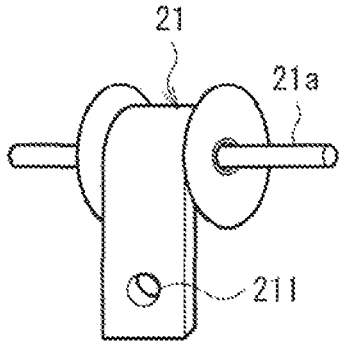
[ FIG. 3B ]
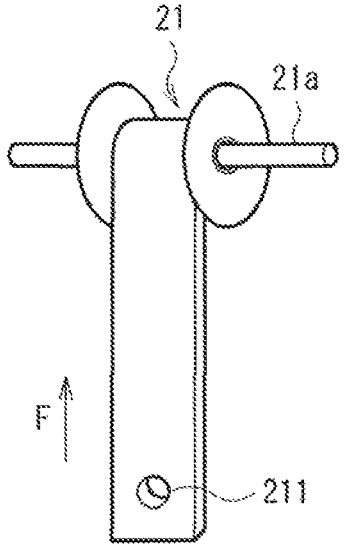

[ FIG. 4 ]
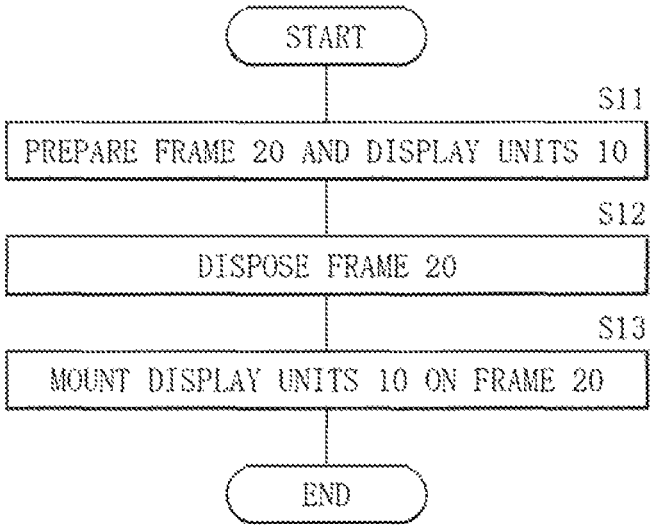

[ FIG. 5 ]
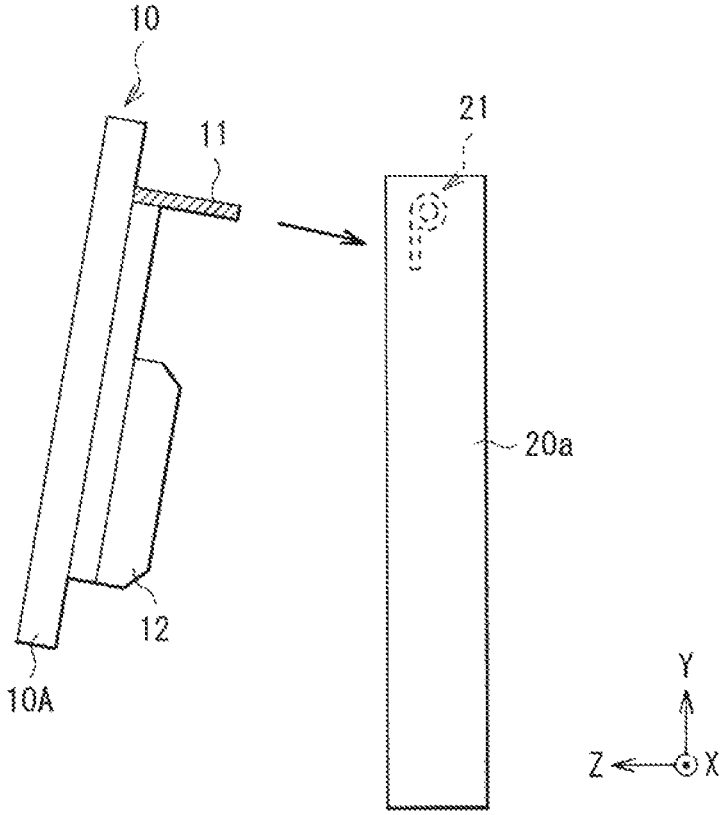
[ FIG. 6 ]
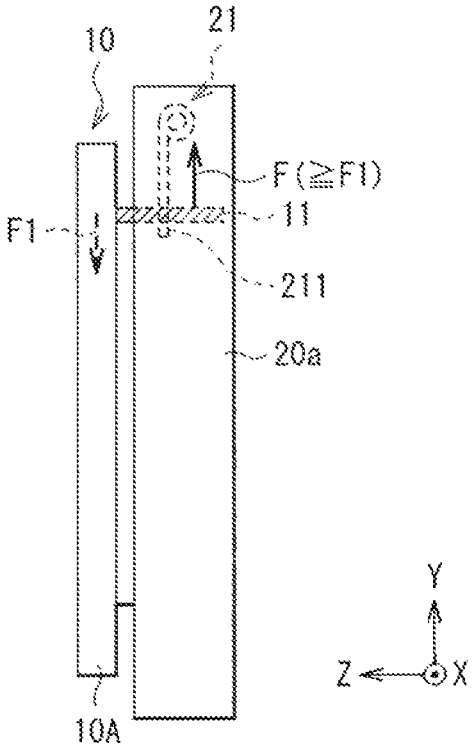

[ FIG. 7 ]
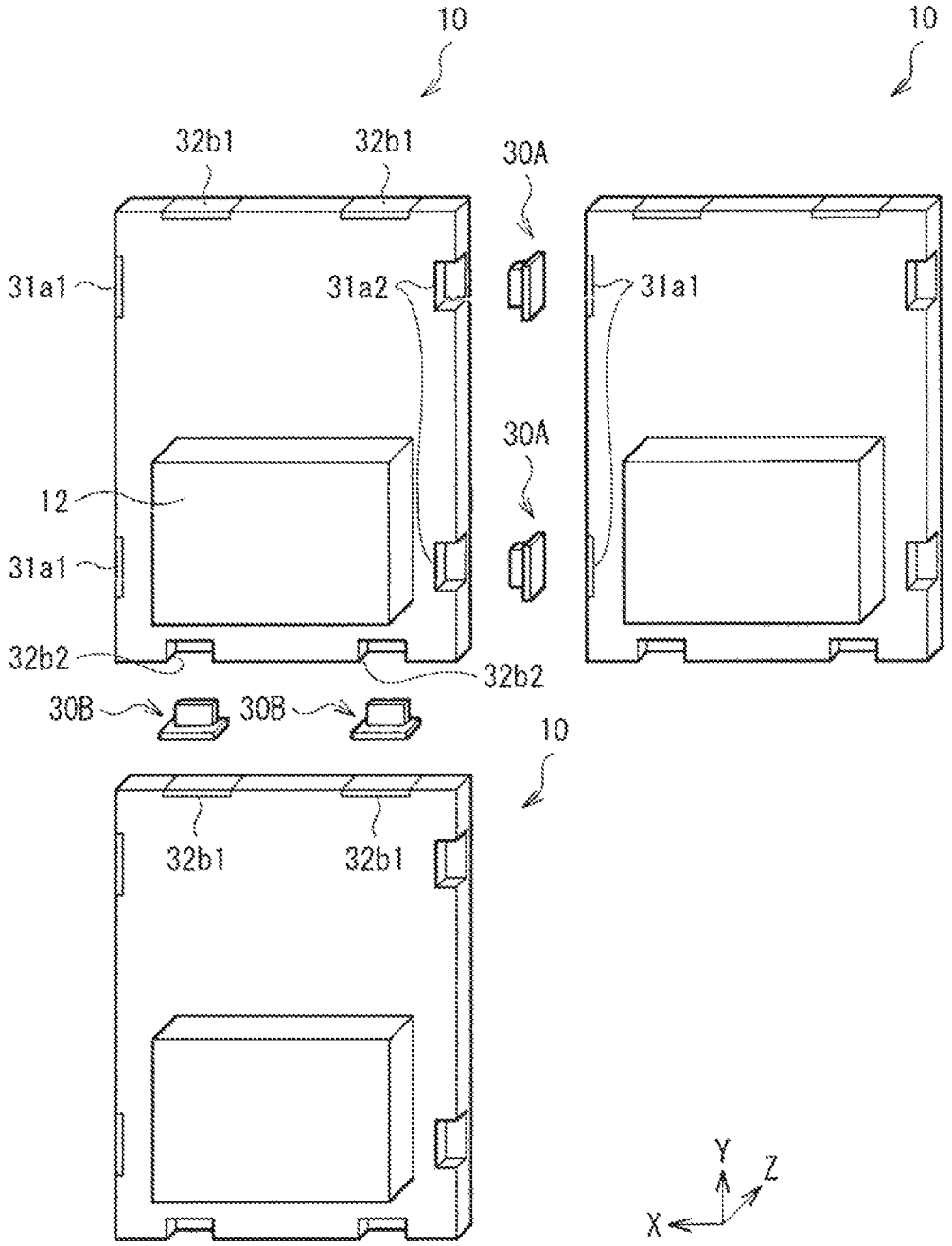

[ FIG. 8 ]
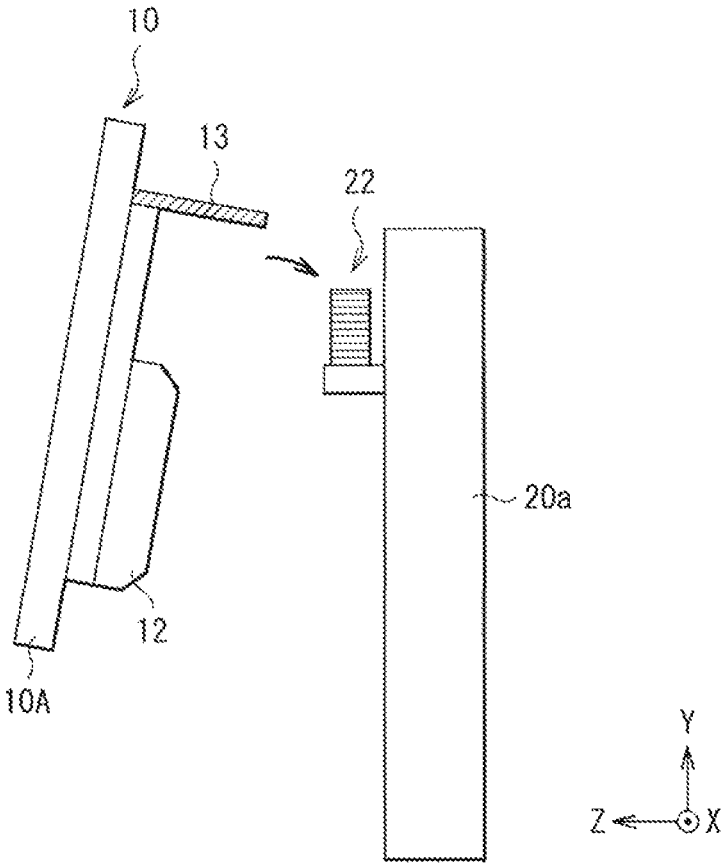
[ FIG. 9 ]
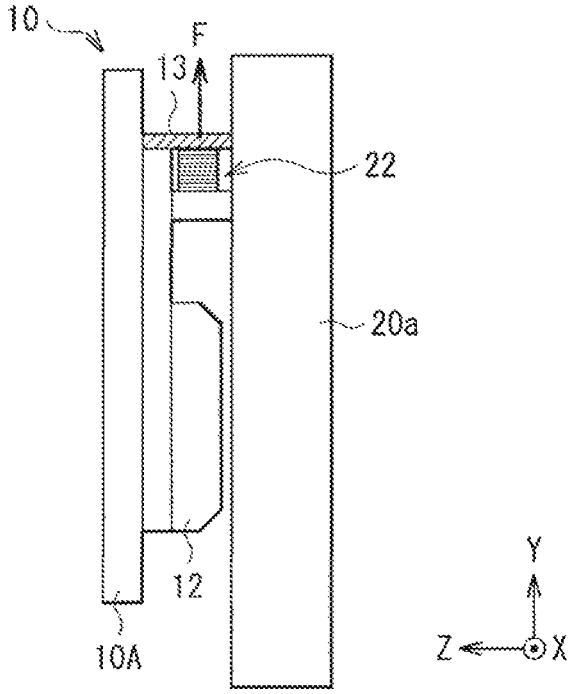

[ FIG. 10 ]
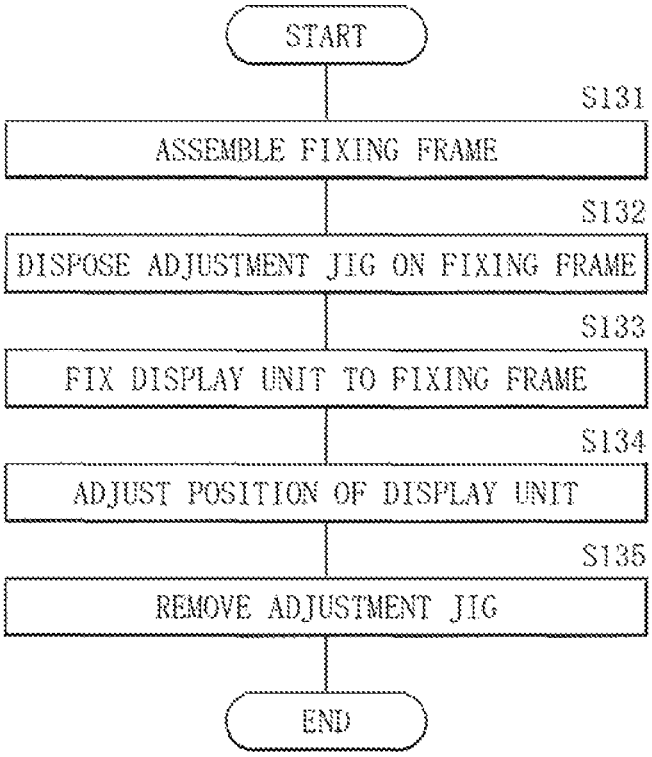

[ FIG. 11 ]
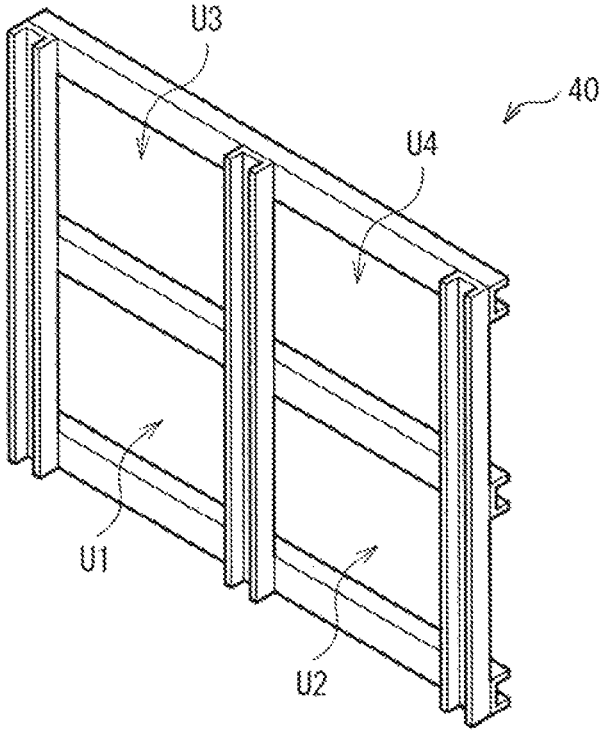
[ FIG. 12 ]
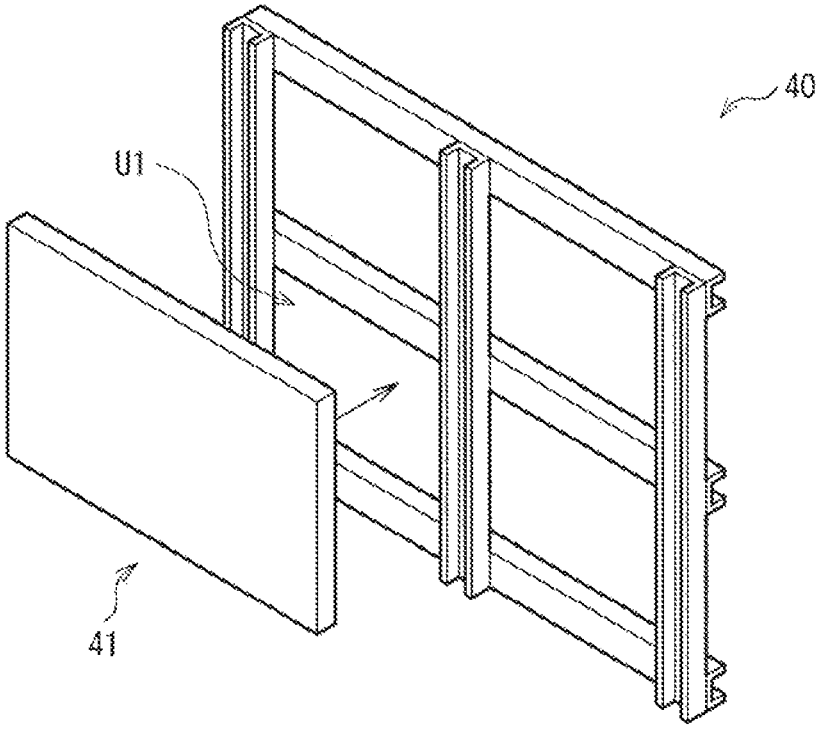

[ FIG. 13 ]
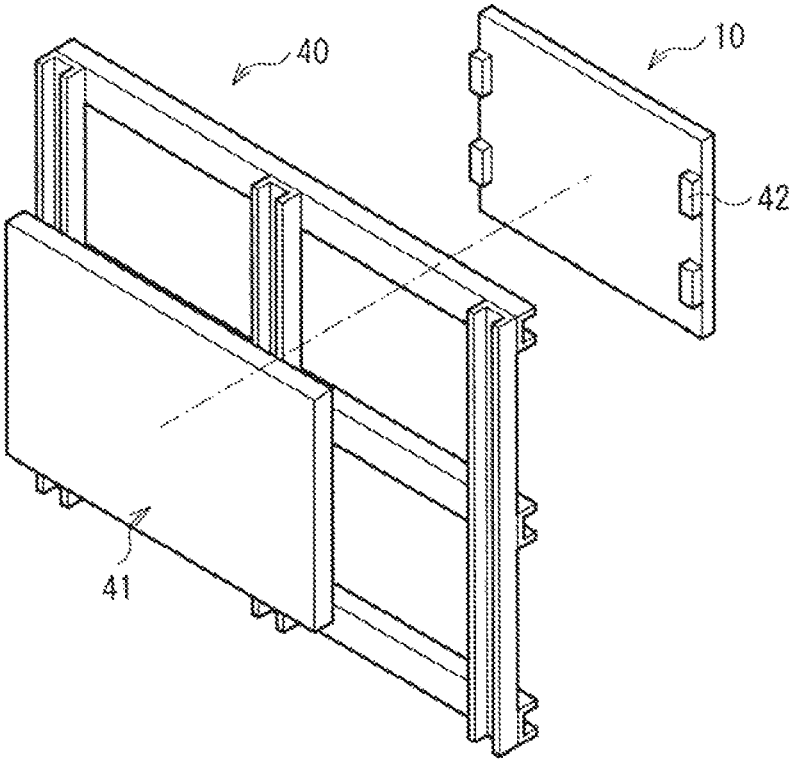
[ FIG. 14 ]
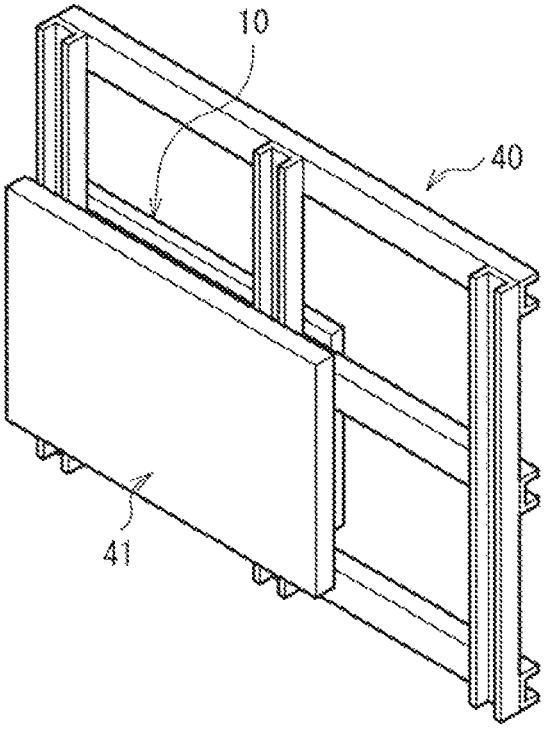

[ FIG. 15 ]
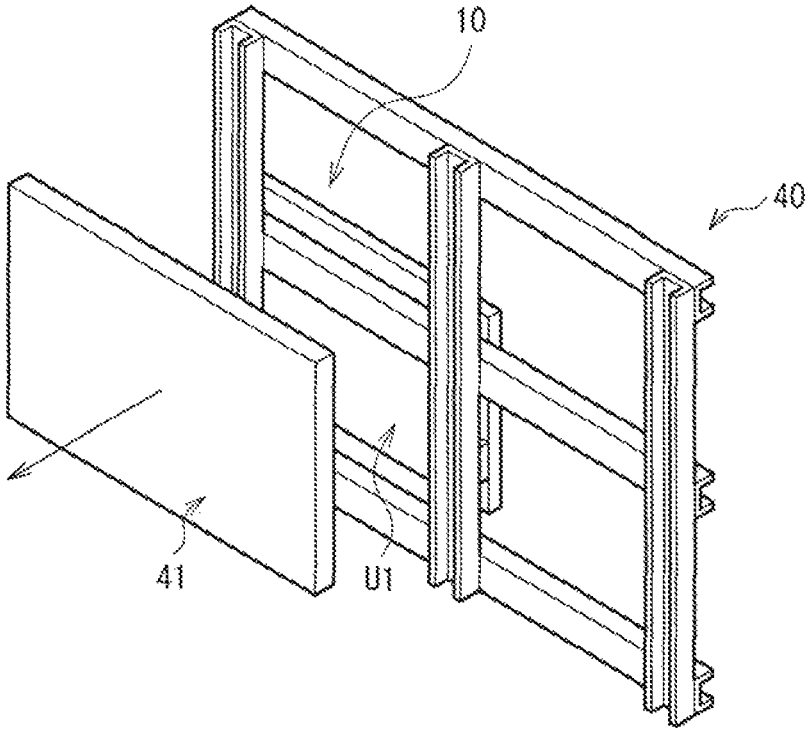
[ FIG. 16 ]
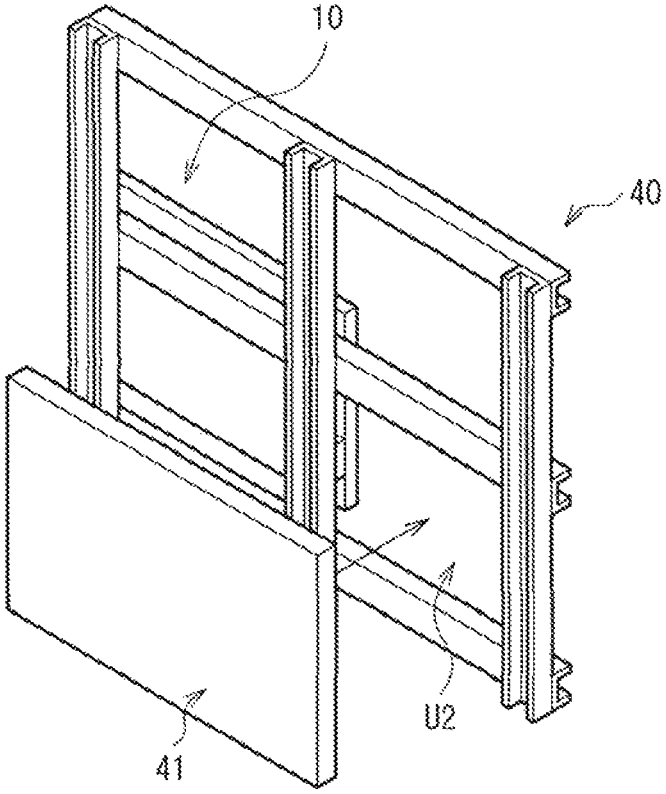

[ FIG. 17 ]
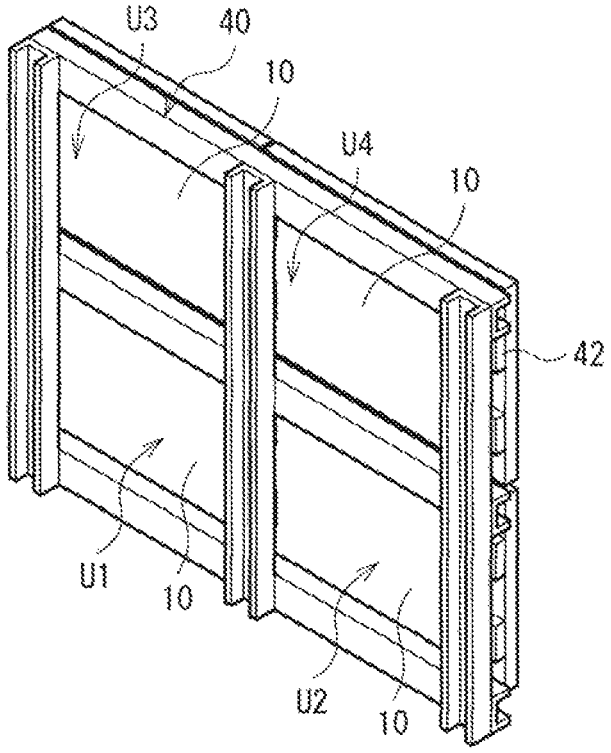

DISPLAY APPARATUS AND CONSTRUCTION METHOD

CROSS REFERENCE TO RELATED APPLICATIONS

This application is a U.S. National Phase of International Patent Application No. PCT/JP2016/063028 filed on Apr. 26, 2016, which claims priority benefit of Japanese Patent Application No. JP 2015-101645 filed in the Japan Patent Office on May 19, 2015. Each of the above-referenced applications is hereby incorporated herein by reference in its entirety.

TECHNICAL FIELD

The present disclosure relates to a display apparatus such as a so-called tiling display, and to a construction method in assembling of such a display apparatus.

BACKGROUND ART

In a large-sized display apparatus (a tiling display) used in outdoors, etc., a plurality of display units (display modules) are typically mounted on a wall of a building, a fame, etc., thereby being two-dimensionally arranged. Various methods have been proposed as methods of constructing such a display apparatus (for example, PTL 1).

In the method disclosed in PTL 1, a supporting mechanism is provided on an outer wall of a building and a plurality of display units are fixed to the supporting mechanism. As a result, the display units are tiled along the outer wall.

CITATION LIST

Patent Literature

PTL 1: Japanese Unexamined Patent Application Publication No. 2004-191401

SUMMARY OF INVENTION

However, in the method disclosed in PTL 1 described above, since the display units are fixed to the supporting mechanism, positional accuracy of each of the display units is easily influenced by accuracy (including distortion) of the supporting mechanism itself, in addition to accuracy (construction accuracy) in mounting of each of the display units on the supporting mechanism. In addition, the weights of the display units are integrated during the construction, which may result in distortion of the supporting mechanism due to the load. Accordingly, it is difficult to achieve positional accuracy of, for example, about several percent with respect to a pixel pitch. Therefore, improvement of the positional accuracy is desired.

It is desirable to provide a display apparatus that makes it possible to improve positional accuracy of display units and a method of constructing such a display apparatus.

A display apparatus according to an embodiment of the present disclosure includes: a plurality of display units that are two-dimensionally arranged; a supporting member that supports the plurality of display units; and an elastic member that partially couples the supporting member and each of some or all of the plurality of display units.

In the display apparatus according to the embodiment of the present disclosure, each of the display units and the supporting member are partially coupled to each other through the elastic member, and each of the display units is not rigidly fixed to the supporting member. As a result, an error in construction hardly occurs, and each of the display units is hardly influenced by distortion of the supporting member.

A construction method according to an embodiment of the present disclosure includes: preparing a plurality of display units and a supporting member that supports the plurality of display units; two-dimensionally arranging the plurality of display units with use of the supporting member; and partially coupling the supporting member and each of some or all of the plurality of display units through an elastic member.

In the construction method according to the embodiment of the present disclosure, each of the display units and the supporting member are partially coupled to each other through the elastic member, and therefore each of the display units is not rigidly fixed to the supporting member. As a result, an error in construction hardly occurs, and each of the display units is hardly influenced by distortion of the supporting member.

In the display apparatus according to the embodiment of the present disclosure, since the elastic member that partially couples each of the display units and the supporting member to each other is provided, each of the display units is not rigidly fixed to the supporting member, which allows for enhancement of construction accuracy. In addition, it is possible to assemble the display units with high accuracy without influence of distortion of the supporting member. Further, even in a case where distortion occurs on the supporting member or the distortion is changed with time, it is possible to maintain positional accuracy of the display units. This allows for improvement of the positional accuracy of the display units.

In the construction method according to the embodiment of the present disclosure, since each of the display units and the supporting member are partially coupled to each other through the elastic member, each of the display units is not rigidly fixed to the supporting member, which allows for enhancement of construction accuracy. In addition, it is possible to assemble the display units with high accuracy without influence of distortion of the supporting member. Further, even in a case where distortion occurs on the supporting member or the distortion is changed with time, it is possible to maintain the positional accuracy of the display units. This allows for improvement of the positional accuracy of the display units.

Note that the above-described contents are examples of the present disclosure. The effects of the present disclosure are not limited to those described above. Effects achieved by the present disclosure may be other different effects or further include other effects.

BRIEF DESCRIPTION OF DRAWINGS

FIG. 1 is a schematic diagram illustrating an entire configuration of a display apparatus according to an embodiment of the present disclosure.

FIG. 2 is a schematic diagram illustrating a configuration example of a coupling portion of each of display units and a frame illustrated in FIG. 1.

FIG. 3A is a schematic diagram to explain a spring (a tension spring) illustrated in FIG. 2.

FIG. 3B is a schematic diagram to explain the spring (the tension spring) illustrated in FIG. 2.

FIG. 4 is a flowchart illustrating a procedure of a method of constructing a display unit.

FIG. 5 is a side view of a state before coupling of the display unit and the frame.

FIG. 6 is a side view of a state after the coupling of the display unit and the frame.

FIG. 7 is a schematic diagram to explain a joint mechanism according to a modification 1.

FIG. 8 is a side view of a state before coupling of a display unit and a frame in a case where a spring (a compression spring) according to a modification 2 is used.

FIG. 9 is a side view of a state after the coupling of the display unit and the frame in the case where the spring (the compression spring) according to the modification 2 is used.

FIG. 10 is a flowchart illustrating a procedure of an assembling method according to a modification 3.

FIG. 11 is a schematic diagram to explain a step in the assembling method illustrated in FIG. 10.

FIG. 12 is a schematic diagram to explain a step following the step of FIG. 11.

FIG. 13 is a schematic diagram to explain a step following the step of FIG. 12.

FIG. 14 is a schematic diagram to explain a step following the step of FIG. 13.

FIG. 15 is a schematic diagram to explain a step following the step of FIG. 14.

FIG. 16 is a schematic diagram to explain a step following the step of FIG. 15.

FIG. 17 is a schematic diagram to explain a step following the step of FIG. 16.

MODES FOR CARRYING OUT THE INVENTION

Some embodiments of the present disclosure are described in detail below with reference to drawings. Note that description is given in the following order.

1. Embodiment (an example of a display apparatus in which a plurality of display units and a frame are coupled through springs)
2. Modification 1 (an example in which a joint member is disposed between adjacent display units)
3. Modification 2 (an example in a case of using a compression spring)
4. Modification 3 (another example of an assembling method)

Embodiment

[Configuration]

FIG. 1 schematically illustrating an entire configuration of a display apparatus (a display apparatus 1) according to an embodiment of the present disclosure. The display apparatus 1 is a large-sized tiling display having a width of, for example, about several meters to about several ten meters. In the display apparatus 1, a plurality of display units 10 are two-dimensionally arranged, and a frame 20 is disposed on rear surface side of the plurality of display units 10.

Each of the display units 10 is a unit (a module) that includes a display panel (a display panel 10A) on which an image is displayed through electrical control. Each of the display units 10 includes the display panel 10A including a pixel array section, and a circuit unit (a circuit unit 12 not illustrated in FIG. 1) that includes a circuit, a power supply, etc. to drive the pixel array section. Note that the configuration illustrated in FIG. 1 is an example, and the number, each shape, arrangement, etc. of the display units 10 are not limited to the illustrated configuration. In addition, although not illustrated, desirably, the display units 10 are each configured such that the side surfaces (the counter surfaces of the respective display units 10) are fitted to the side surfaces of the respective adjacent display units 10, and are coupled to one another.

In the pixel array section of the display panel 10A, for example, a plurality of pixels are two-dimensionally arranged. For example, light-emitting devices emitting light of three primary colors of red (R), green (G), and blue (B) are disposed in each of the pixels. Examples of the light-emitting devices include a light-emitting diode (LED). Specifically, the display panel 10A is, for example, a glass epoxy substrate on which LEDs are mounted. In the pixel array section, each of the pixels is pulse-driven on the basis of an image signal externally provided, thereby adjusting luminance of each of the LEDs and displaying the image.

The frame 20 is a structure (a support or a back frame) that is provided on the rear surface side of the display units 10, and supports the display units 10. In a case where the display units 10 are stacked in multi-stages to assemble the display apparatus 1, the frame 20 is used because upsizing is difficult only with rigidity of the individual display units 10. A material with light weight and excellent in heat dissipation, for example, aluminum (Al) simple substance or an alloy containing aluminum is desirably used for the frame 20.

The frame 20 includes a plurality of pillars 20*a*. For example, the plurality of pillars 20*a* extend in one direction and are separately disposed with constant intervals from one another. A shape of each of the pillars 20*a* is not particularly limited, and is, for example, a polygonal pillar shape such as a square pillar shape, or a columnar shape. Each of the pillars 20*a* may be chamfered or may be provided with a concave portion or a convex portion according to the shape of each of the display units 10. Further, the configuration in which the frame 20 includes the plurality of pillars 20*a* that are separated from one another is exemplified in this case; however, the pillars 20*a* may be partially coupled to one another. Alternatively, a member extending along an X direction may be used for reinforcement. Such a frame 20 may be fabricated by, for example, die casting (a die casting technology). Note that the frame 20 and the pillars 20*a* in the present embodiment correspond to a specific example of a "supporting member" in the present disclosure.

The frame 20 is disposed such that the pillars 20*a* extend along a direction (a Y direction) perpendicular to an XZ plane (for example, a floor or a ground), or along a direction parallel to an XY plane (for example, a wall surface). The frame 20, however, is not limited to the case of being perpendicular to the floor, the ground, etc., and may be disposed to be inclined depending on an application. In addition, the frame 20 is not limited to the case of being parallel to the wall surface, and may be disposed to be inclined to the wall surface.

In the frame 20, for example, two pillars 20*a* are so separately disposed as to sandwich the display units 10 of one column (the plurality of display units 10 arranged along the Y direction). In the present embodiment, the display units 10 are partially coupled to the two pillars 20*a* through elastic members (springs 21). Each of all of the display units 10 provided in the display apparatus 1 may be coupled to the pillars 20*a* through the springs 21, or each of some (disposed in selective positions) of the display units 10 may be coupled to the pillars 20*a* through the springs 21.

FIG. 2 is a schematic diagram to explain a configuration of a coupling portion of each of the display units 10 and the frame 20 (the pillars 20*a*). Note that FIG. 2 only illustrates a portion corresponding to two display units 10 that are vertically arranged. As illustrated, the two pillars 20*a* are disposed on the rear surface side of the display units 10 of one column. A mechanism that holds the springs 21 is provided on the pillars 20*a*.

For example, a tension spring may be used as each of the springs 21. FIG. 3A and FIG. 3B illustrate one spring 21 in an enlarged manner. The spring 21 is, for example, a tension spring wound in a roll shape, and is suspended from the pillars 20*a*. As illustrated in FIG. 3B, when the spring 21 is pulled downward from a state illustrated in FIG. 3A, the spring 21 energizes (generates energizing force (F)) in a direction (a positive Y direction, or upward) cancelling the weight of the corresponding display unit 10 by restoring force of the spring 21. The energizing force F of the spring 21 is desirably equal to or larger than the weight of the corresponding display unit 10. This is because, as described later, the weight of the display unit 10 is distributed to the pillars 20*a* by the energization of the spring 21, which reduces integrated load applied to the display unit 10 that is located, in particular, at a lower position of a group of the stacked display units 10.

A shaft 21*a* and a shaft receiver 21*b* that rotatably hold the spring 21 are disposed between counter surfaces of the two pillars 20*a*. The shaft 21*a* may be bonded to the shaft receiver 21*b* or may be detachably held by the shaft receiver 21*b* (without bonding). The shaft receiver 21*b* is, for example, a U-shaped saucer, and is disposed at a predetermined position of each of the pillars 20*a*.

The spring 21 includes a portion that is held to the pillars 20*a* (the frame 20) by the shaft 21*a* and the shaft receiver 21*b* as described above, and engages with the display unit 10. In this case, a hole 211 is provided at an end of the spring 21, and a portion (a projection 11) of the display unit 10 is locked while being inserted into (fitted to) the hole 211. The projection 11 is a rod-shaped member (or a portion) that is fixed to (or integrally provided on) a rear surface of the display unit 10 and projects in a negative Z direction. The projection 11 is not desirably bonded to the spring 21 (the hole 211). This is because flexibility of the coupling position between the display unit 10 and the frame 20 becomes high and positional accuracy is more favorably maintained without influence of distortion of the pillars 20*a*. Moreover, the projection 11 is not bonded, which makes it possible to easily demount the display unit 10 from the pillars 20*a* at the time of, for example, maintenance or relocation of the display apparatus 1. This enhances handleability.

Note that the spring 21 is not limited to the roll-shaped spring as described above, and a spring having any of other various shapes such as a coil shape, a wave shape, and a plate shape may be used. In any case, the display unit 10 and the pillars 20 are desirably coupled to one another such that the weight of the display unit 10 is cancelled by energization of the spring 21.

[Construction Method]

The display apparatus 1 as described above is assembled (constructed), for example, in the following manner. FIG. 4 illustrates a procedure of a method of constructing the display apparatus 1. In other words, first, the frame 20 fabricated through, for example, aluminum die casting and the plurality of display units 10 are prepared (step S11). Subsequently, the prepared frame 20 is disposed (step S12). Next, the display units 10 are mounted on the frame 20 (are assembled with use of the frame 20) (step S13).

To mount the display units 10 on the frame 20 (the pillars 20*a*), the display units 10 and the frame 20 are partially coupled to one another through the springs 21. Specifically, the display units 10 are so mounted on the pillars 20*a* as to be stacked one by one from lower side of the pillars 20*a*. To mount one display unit 10 on the pillars 20*a*, for example, the projection 11 of the display unit 10 is inserted into and hooked on the hole 211 of each of the springs 21 (FIGS. 5 and 6). The springs 21 in a contracted state are held by the pillars 20*a* before coupling (FIG. 5). After the projection 11 of the display unit 10 is inserted into the hole 211 of each of the springs 21 to couple the display unit 10 to the pillars 20*a* (FIG. 6), the springs 21 extend by the weight of the display unit 10. As a result, the display unit 10 is energized (the energizing force is applied to the display unit 10). The energizing force F is generated in a direction (the positive Y direction) cancelling a weight F1 of the display unit 10, and relationship of FF1 is desirably satisfied. This distributes the weight of the display unit 10 into the pillars 20*a*, which relieves integration of the load applied to the other display unit 10 that is disposed below the display unit 10.

As described above, the display unit 10 and the frame 20 are partially coupled to each other through the springs 21, which prevent the display unit 10 from being rigidly fixed to the frame 20. As a result, an error in construction hardly occurs. In addition, it is possible to assemble the display units 10 with high accuracy without influence of distortion of the frame 20 (the pillars 20*a*).

[Effects]

In the display apparatus 1 according to the present embodiment, providing the elastic members (the springs 21) that partially couple the display unit 10 and the frame 20 prevents the display unit 10 from being rigidly fixed to the frame 20. In a typical method, the display units are sequentially rigidly fixed to the frame. Therefore, the mounted position of the display unit follows distortion of the frame. In other words, the positional accuracy of the display unit depends on member accuracy of the frame itself, in addition to construction accuracy, which makes it difficult to maintain favorable positional accuracy. In the present embodiment, since the display unit 10 is not rigidly fixed to the frame 20, error in construction hardly occurs. In addition, the display unit 10 is hardly influenced by distortion of the frame 20 through interposition of the springs 21, which makes it possible to assemble the display unit 10 with high accuracy. Furthermore, even in a case where distortion occurs on the pillars 20*a* or is changed with time, it is possible to maintain favorable positional accuracy of the display unit 10. This allows for improvement of the positional accuracy of the display unit 10.

Accordingly, it is possible to assemble the display unit 10 with accuracy of, for example, several percent or lower to a pixel pitch, and to achieve a tiling display with no joint or with an inconspicuous joint.

In addition, the springs 21 are each configured to energize the display unit 10 in the direction cancelling the weight of the display unit 10, which distributes the weight of the display unit 10 into the pillars 20*a*. This makes it possible to relieve integration of the load applied to the other display unit 10 that is disposed below the display unit 10. Accordingly, it is possible to suppress occurrence of positional displacement, distortion, etc. caused by the load on the display unit 10 disposed, in particular, on lower side, and to maintain more favorable positional accuracy.

Furthermore, the springs 21 and the display unit 10 are coupled to one another while being not bonded to one another, which enhances flexibility of the coupling position between the display unit 10 and the frame 20. This makes it possible to more favorably maintain the positional accuracy without influence of distortion of the pillars 20*a*. Moreover, demounting of the display unit 10 becomes easy, which makes it possible to easily perform maintenance and relocation and to accordingly improve handleability.

In addition, the load applied to the display unit 10 is reduced as described above, which makes it possible to reduce rigidity of the individual display unit 10 (which eliminates necessity of maintaining high rigidity). This leads to reduction in thickness and weight of the display unit 10.

Modifications of the above-described embodiment are described below. Note that components similar to those of the above-described embodiment are denoted by the same reference numerals, and description of such components is appropriately omitted.

<Modification 1>

FIG. 7 is a schematic diagram to explain a joint mechanism according to a modification 1. In the above-described embodiment, the configuration in which the adjacent display units 10 are coupled to each other through shape engagement has been described; however, the adjacent display units 10 are desirably coupled to each other through interposed other components (joint members 30A and 30B).

The joint member 30A is disposed between the adjacent display units 10 in the X direction. Portions 31*a*1 and 31*a*2 to which the joint member 30A is fitted are provided on side surfaces of the display unit 10 (the counter surfaces of the respective display units 10). The joint member 30B is disposed between the adjacent display units 10 in the Y direction. Portions 32*b*1 and 32*b*2 to which the joint member 30B is fitted are provided on side surfaces of the display unit 10 (the counter surfaces of the respective display units 10).

The joint member 30A and the portions 31*a*1 and 31*a*2 are aligned along, for example, three axis directions of X, Y, and Z by being adjustably fastened to one another through, for example, a screw. Likewise, the joint member 30B and the portions 32*b*1 and 32*b*2 are aligned along, for example, three axis directions of X, Y, and Z by being adjustably fastened to one another through, for example, a screw.

Providing the joint mechanism according to the present modification between the display units 10 makes it possible to couple the display units 10 to one another and to precisely adjust a gap between the display units 10, the positions of the respective display units 10, etc. It is possible to achieve more accurate tiling.

<Modification 2>

FIG. 8 and FIG. 9 are side views each illustrating a state before coupling of the display unit and the frame in a case of using a spring (a compression spring) according to a modification 2. The configuration using the tension spring as the elastic member of the present disclosure has been exemplified in the above-described embodiment; however, the compression spring (a spring 22) may be used as in the present modification.

The spring 22 is, for example, a coiled compression spring, and one end of the spring 22 is disposed on each of the pillars 20*a* of the frame 20. The other end of the spring 22 is configured to engage with a portion (a projection 13) of the display unit 10. For example, the projection 13 is placed on a top of the spring 22, which causes the display unit 10 to be mounted on the pillars 20*a*. The projection 13 is a rod-like or a plate-like member (or a portion) that is fixed to (or integrally provided on) the rear surface of the display unit 10 and projects in the negative Z direction. The projection 13 is not desirably bonded to the spring 22. This is because flexibility of the coupling position between the display unit 10 and the frame 20 becomes high, and the positional accuracy is more favorably maintained without influence of distortion of the pillars 20*a*. Moreover, the projection 13 is not bonded, which makes it possible to easily demount the display unit 10 from the pillars 20*a* at the time of, for example, maintenance or relocation of the display apparatus 1. This enhances handleability.

The display unit 10 and the pillars 20*a* are desirably coupled to one another such that the weight of the display unit 10 is cancelled by energization of the spring 22, as with the above-described embodiment.

Even in the present modification, to mount the display unit 10 on the frame 20 (the pillars 20*a*), the display unit 10 and the frame 20 are partially coupled to each other through the springs 22, as with the above-described embodiment. Specifically, to mount one display unit 10 on the pillars 20*a*, for example, the projection 13 of the display unit 10 is placed on the top of the spring 22 (FIGS. 8 and 9). Before the coupling (FIG. 8), the spring 22 in an extended state is held by each of the pillars 20*a*. After the projection 13 of the display unit 10 is placed on the spring 22 and the display unit 10 is coupled to the pillars 20*a* (FIG. 9), the spring 22 is contracted (compressed) by the weight of the display unit 10. As a result, the display unit 10 is energized (the energizing force F is applied to the display unit 10). The energizing force F is generated in a direction (the positive Y direction) cancelling the weight F1 of the display unit 10, and relationship of FF1 is desirably satisfied. This distributes the weight of the display unit 10 into the pillars 20*a* as with the above-described embodiment, which relieves integration of the load applied to the other display unit 10 that is disposed below the display unit 10.

As described above, also in the present modification, the display unit 10 and the frame 20 are partially coupled to each other through the springs 22, which prevents the display unit 10 from being rigidly fixed to the frame 20. This makes it possible to achieve effects equivalent to the effects of the above-described embodiment.

<Modification 3>

FIG. 10 is a flowchart to explain an assembling method according to a modification 3. The method of directly mounting the display unit 10 on the frame 20 (the pillars 20*a*) has been described (in step S13 of FIG. 4) in the above-described embodiment; however, the method of mounting (assembling) the display unit 10 on the frame 20 is not limited to the above-described method. For example, as with the present modification, a separate frame (a fixing frame 40) may be used to fix the display unit 10 to the frame 20. A procedure of the assembling method using the fixing frame 40 is described below.

In this case, the fixing frame 40 is first assembled (step S131). As illustrated in FIG. 11, the fixing frame 40 includes a plurality of unit regions that are, for example, mounting spaces of the respective display units 10. In this example, the fixing frame 40 includes four unit regions U1 to U4 arranged in 2*x*2. The number, the size, etc. of the unit regions, however, are not particularly limited, and are appropriately set depending on the size of each of the display unit 10 and the frame 20, etc.

Subsequently, as illustrated in FIG. 12, an adjustment jig 41 is so disposed as to face one unit region U1 of the fixing frame 40 (step S132).

Thereafter, as illustrated in FIG. 13, one display unit 10 is fixed to the fixing frame 40 with use of the adjustment jig 41 (step S133). Specifically, the display unit 10 is clamped by the fixing frame 40 with use of the adjustment jig 41 while the fixing frame 40 is disposed between the adjustment jig 41 and the display unit 10. Further, positional adjustment of the display unit 10 is performed with use of the adjustment jig 41 (step S134). Note that a coupling member 42 to be coupled to the fixing frame 40 is previously attached to the display unit 10. Using the fixing frame 40 and the adjustment jig 41 in this manner makes it possible to fix the display unit 10 to the fixing frame 40 while performing positional adjustment of the display unit 10, as illustrated in FIG. 14.

Thereafter, as illustrated in FIG. 15, the display unit 10 is unclamped, and the adjustment jig 41 is removed from the fixing frame 40 (step S135). The display unit 10 is mounted on the unit region U1 of the fixing frame 40 in the above-described manner.

Subsequently, as illustrated in FIG. 16, the adjustment jig 41 is so disposed as to face the unit region U2 of the fixing frame 40. Thereafter, one display unit 10 is mounted on the fixing frame 40 through a procedure similar to the procedure of step S133 to step S135 described above. Note that, to mount the display unit 10 on second or subsequent unit region among the unit regions of the fixing frame 40, the positional adjustment is preferably performed on the basis of the position of the adjacent display unit 10.

As illustrated in FIG. 17, it is possible to fix the display units 10 to all of the unit regions U1 to U4 of the fixing frame 40 in the above-described manner. The fixing frame 40 in which the display units 10 have been fixed to the respective unit regions U1 to U4 is mounted on the frame 20 similar to that in the above-described embodiment, which makes it possible to assemble a tiling display. Moreover, as described in the above-described embodiment, in mounting on the frame 20, the fixing frame 40 is partially coupled to the frame 20 with use of the elastic members such as springs, which causes the fixing frame 40 to be hardly influenced by distortion of the pillars 20*a* and cancels the weight of the fixing frame 40. This makes it possible to maintain the favorable positional accuracy. Accordingly, it is possible to achieve effects substantially equivalent to the effects of the above-described embodiment.

Hereinbefore, although the present disclosure has been described with reference to the embodiment and the modifications, the present disclosure is not limited to the embodiment and the modifications, and various modifications may be made. For example, in the embodiment and the modifications described above, the display unit 10 including the display panel on which the LEDs are mounted has been exemplified; however, the display unit of the present disclosure is not limited to the display unit using the LEDs, and the present disclosure is applicable to a unit including other various display devices.

Further, in the embodiment and the modifications described above, the description has been given by assuming the large-sized tiling display; however, the contents of the present disclosure are applicable to a middle-sized or small-sized tiling display. Even in a case of the small-sized tiling display, distortion of the frame and integration of load due to stacking of the display units occur. Therefore, it is possible to improve the positional accuracy for the reason similar to the reason in the case of the large-sized tiling display. Since large effects are achievable particularly in the large-sized tiling display, the present disclosure suggests the apparatus configuration and the construction method suitable for upsizing.

Further, in the embodiment and the modifications described above, the spring has been described as an example of the elastic member of the present disclosure; however, the member may be a member (for example, rubber) having no (or weak) energizing force caused by expansion and contraction (tension or compression) as long as the member has elasticity. Even if the member has scarce energizing force caused by expansion and contraction, influence of distortion of the frame is relieved by elasticity. Therefore, it is possible to enhance positional accuracy of the display unit.

It is to be noted that the contents of the present disclosure may have the following configurations.

(1)

A display apparatus, including:

a plurality of display units that are two-dimensionally arranged;

a supporting member that supports the plurality of display units; and an elastic member that partially couples the supporting member and each of some or all of the plurality of display units.

(2)

The display apparatus according to (1), in which the elastic member energizes corresponding one of the display units in a direction canceling a weight of the corresponding display unit.

(3)

The display apparatus according to (2), in which the elastic member includes a portion that is held by the supporting member and engages with a portion of the corresponding display unit.

(4)

The display apparatus according to (3), in which the elastic member includes a spring.

(5)

The display apparatus according to (4), in which the spring is a tension spring that is suspended from the supporting member.

(6)

The display apparatus according to (4), in which the spring is a compression spring disposed on the supporting member.

(7)

The display apparatus according to any one of (1) to (6), in which the elastic member is not bonded to corresponding one of the display units.

(8)

The display apparatus according to any one of (1) to (7), further including a joint member that joints adjacent display units of the plurality of display units with each other.

(9)

The display apparatus according to any one of (1) to (8), in which the supporting member includes a plurality of pillars that extend in one direction and are provided separately from one another.

(10)

A construction method, including:

preparing a plurality of display units and a supporting member that supports the plurality of display units;

two-dimensionally arranging the plurality of display units with use of the supporting member; and partially coupling the supporting member and each of some or all of the plurality of display units through an elastic member.

(11)

The construction method according to (10), in which the elastic member energizes corresponding one of the display units in a direction cancelling a weight of the corresponding display unit.

(12)

The construction method according to (11), in which the elastic member includes a portion that is held by the supporting member and engages with a portion of the corresponding display unit.

(13)

The construction method according to (12), in which the elastic member includes a spring.

(14)

The construction method according to (13), in which the spring is a tension spring that is suspended from the supporting member.

(15)

The construction method according to (13), in which the spring is a compression spring disposed on the supporting member.

(16)

The construction method according to any one of (10) to (15), in which the elastic member is not bonded to corresponding one of the display units.

(17)

The construction method according to any one of (10) to (16), in which a joint member is provided, the joint member that joints adjacent display units of the plurality of display units with each other.

(18)

The construction method according to any one of (10) to (17), in which the supporting member includes a plurality of pillars that extend in one direction and are provided separately from one another.

This application is based upon and claims the benefit of priority of the Japanese Patent Application No. 2015-101645 filed with the Japan Patent Office on May 19, 2015, the entire contents of which are incorporated herein by reference.

It should be understood by those skilled in the art that various modifications, combinations, sub-combinations, and alterations may occur depending on design requirements and other factors insofar as they are within the scope of the appended claims or the equivalents thereof.

The invention claimed is:

1. A display apparatus, comprising:

a plurality of display units that are two-dimensionally arranged, wherein each display unit of the plurality of display units includes a pixel array section;

a supporting member configured to support the plurality of display units;

an elastic member configured to partially couple the supporting member and a portion that projects from a rear surface of each display unit of the plurality of display units; and a joint member configured to join adjacent display units of the plurality of display units with each other.

2. The display apparatus according to claim 1, wherein the elastic member is further configured to energize a corresponding display unit of the plurality of display units in a direction that cancels a weight of the corresponding display unit.

3. The display apparatus according to claim 2, wherein the elastic member includes a portion that is held by the supporting member, and the elastic member engages with the portion of the corresponding display unit.

4. The display apparatus according to claim 1, wherein the elastic member is not bonded to at least one display unit of the plurality of display units.

5. The display apparatus according to claim 1, wherein the supporting member includes a plurality of pillars that extends in one direction, and the plurality of pillars is separated from one another.

6. A construction method, comprising:

providing a plurality of display units and a supporting member configured to support the plurality of display units, wherein each display unit of the plurality of display units includes a pixel array section;

two-dimensionally arranging the plurality of display units with use of the supporting member;

partially coupling the supporting member and a portion that projects from a rear surface of each display unit of the plurality of display units through an elastic member; and joining adjacent display units of the plurality of display units with each other through a joint member.

7. The construction method according to claim 6, further comprising energizing, by the elastic member, a corresponding display unit of the plurality of display units in a direction cancelling a weight of the corresponding display unit.

8. The construction method according to claim 7, wherein the elastic member includes a portion that is held by the supporting member, and the method further comprising engaging the elastic member with the portion of the corresponding display unit.

9. The construction method according to claim 6, wherein the elastic member is not bonded to at least one display unit of the plurality of display units.

10. The construction method according to claim 6, wherein the supporting member includes a plurality of pillars that extends in one direction, and the plurality of pillars is separated from one another.

11. A display apparatus, comprising:

a plurality of display units that are two-dimensionally arranged;

a supporting member configured to support the plurality of display units;

an elastic member configured to partially couple the supporting member and each of one or more of the plurality of display units; and a joint member configured to join adjacent display units of the plurality of display units with each other.

12. A display apparatus, comprising:

a plurality of display units that are two-dimensionally arranged;

a supporting member configured to support the plurality of display units; and an elastic member configured to partially couple the supporting member and each of one or more of the plurality of display units, wherein the elastic member includes a spring, the elastic member is further configured to energize a corresponding display unit of the plurality of display units in a direction that cancels a weight of the corresponding display unit, and the elastic member includes a portion that is held by the supporting member and engages with a portion of the corresponding display unit.

13. The display apparatus according to claim 12, wherein the spring is a tension spring suspended from the supporting member.

14. The display apparatus according to claim 12, wherein the spring is a compression spring disposed on the supporting member.

* * * * *